United States Patent [19]

Kissinger et al.

[11] 4,121,413

[45] Oct. 24, 1978

[54] BATTERY OPERATED ELECTRIC CLOCK WITH IMPROVED CASING

[75] Inventors: Heinrich Kissinger, Griesheim; Franz Gutmann, Frankfurt, both of Germany

[73] Assignee: VDO Adolf Schindling AG,, Frankfurt am Main, Germany

[21] Appl. No.: 768,903

[22] Filed: Feb. 15, 1977

[30] Foreign Application Priority Data

Feb. 24, 1976 [DE] Fed. Rep. of Germany ..... 2607398

[51] Int. Cl.[2] ..... G04C 21/16; G04C 3/00; G04B 37/00

[52] U.S. Cl. ..... 58/19 R; 58/23 R; 58/38 R; 58/53

[58] Field of Search ..... 58/19 R, 23 R, 38 R, 58/38 A, 52 R, 53–55, 57.5, 59, 85.5, 88 R, 152 B, 7

[56] References Cited

U.S. PATENT DOCUMENTS

| | | | |
|---|---|---|---|
| 3,945,192 | 3/1976 | Wolber | 58/55 |
| 3,977,177 | 8/1976 | Egger | 58/38 R |

FOREIGN PATENT DOCUMENTS

| | | | |
|---|---|---|---|
| 2,124,861 | 11/1972 | Fed. Rep. of Germany | 58/53 |
| 364,296 | 1/1932 | United Kingdom | 58/53 |

*Primary Examiner*—Edith S. Jackmon
*Attorney, Agent, or Firm*—Otto John Munz

[57] ABSTRACT

An improved rectangular casing is provided in three parts for a quartz-crystal electric clock. A middle portion of the casing holds the mechanical and electrical portions of the clockwork and the dial. A front portion of the casing holds a sight glass over the dial and engages the middle portion. A rear portion of the casing engages the middle portion. When the rear portion is removed, conductors on a printed circuit board which carries the clockwork are exposed, as well as a battery chamber.

12 Claims, 5 Drawing Figures

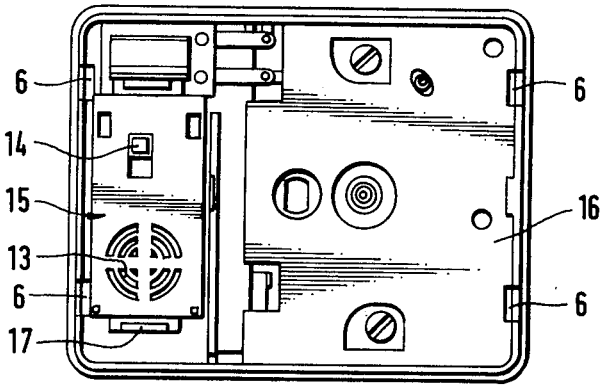
FIG. 2
Fig. 3
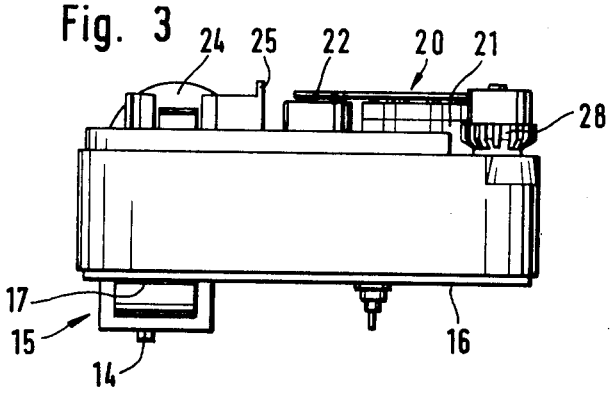
Fig. 4
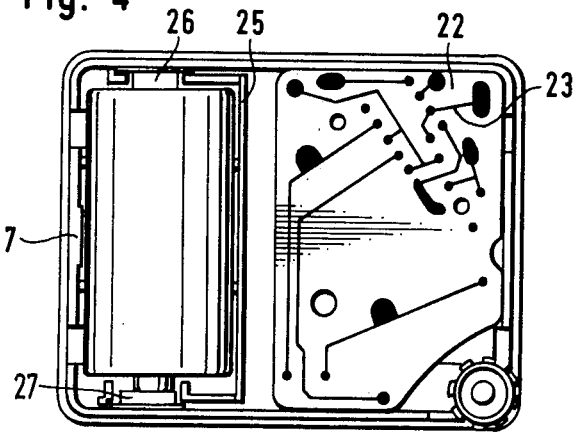
Fig. 5
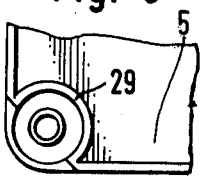

BATTERY OPERATED ELECTRIC CLOCK WITH IMPROVED CASING

BACKGROUND OF THE INVENTION

1. Field of the Invention

The invention relates to a battery-operated electric clock, particularly a quartz-crystal clock, with a casing sealable by means of a cover and provided with a sight glass, for holding the clockwork which comprises an electric and a mechanical portion, one or more batteries, and possibly an alarm device.

2. Description of the Prior Art

Clocks are already known wherein the electrical and mechanical portion of the clockwork are contained in a two-part clockwork casing of plastic material, provided with a prolongation for holding a battery. Such a clockwork casing has two openings from which the setting elements for the hand mechanism and the alarm device project. This clockwork casing which contains the clockwork is located in a further two-part clockwork casing which consists likewise of plastic material and to the front portion of which the dial is fastened. The buzzer and the switch for switching the alarm device on and off are provided in the front portion of the clockwork casing. The rear portion of the clockwork casing has two openings for the setting elements as well as a battery opening which is sealable by means of a cover. The two portions of the clockwork casing as well as those of the clock casing are connected in such a way as to engage each other. Such clocks present the disadvantage of a voluminous and expensive structure which is difficult to manufacture.

In another known clock, the mechanical portion of the clockwork is fixed on the printed-circuit board of the electrical portion. The printed-circuit board supports a plate on the side provided with the conductor lines. The dial is mounted on the plate. On the backside of the board, holding elements for a battery are provided. The printed-circuit board is fastened, by means of four screws, in the front portion of a two-part casing. The setting elements for the hand mechanism and the alarm device are located inside the casing, so that for setting of the clock or the alarm, the rear portion of the casing must be removed. Such a clock has a structure of fewer parts and smaller volume and is easier to manufacture than the clock described above, but it has other substantial disadvantages. For instance, the electrical and mechanical portions of the clock are completely unprotected, so that while the clock or the alarm is being set, damages in the electronic parts or on the oscillating armature drive motor may occur. Since the conductor lines provided on the printed circuit board are no longer accessible after the installation of the printed circuit board in the casing, electrical testing of the individual circuits of the clock after their installation is no longer possible or is possible only under considerable difficulties. A further substantial disadvantage of this clock is that the clockwork cannot be combined with other casing shapes and types without additional structural elements.

SUMMARY OF THE INVENTION

These disadvantages of the known clocks are to be overcome by the invention. The present invention provides a battery-operated electric clock having a small volume, having a structure as simple, inexpensive, and easy to manufacture as possible and in addition, permitting a combination of the complete clockwork with different casing shapes and types, as well as with different dials. Furthermore, testing of the individual circuits of the clock after its complete assembly is possible without difficulties. Finally, the clock is quite simple and uncomplicated to handle.

The invention provides a device wherein the casing consists of a middle portion with a separating wall for supporting the clockwork and possibly the alarm device as well as the dial, a front portion supporting the sight glass, and a rear portion, which elements are connected in such a way as to releasably engage each other.

Thus, after the removal of the front portion which supports the sight glass, and of the rear portion, the middle portion with the clockwork can be installed in any other casing. This allows a substantially more space-saving combination in comparison with the known clock. Moreover, the middle portion containing the clockwork can be fastened in a mechanically engaging manner to one of the casing portions wherein the middle portion is inserted, which structure offers substantial advantages in assembly technique. Likewise, it is possible to fasten the middle portion and the rear portion to a holding element supporting a dial, which fastening manner is preferred mainly in wall clocks.

As a result of the division of the casing into three parts, good accessibility to the individual elements of the clock is allowed. This fact has a favorable effect upon the assembly of the clock. In addition, the testing of the clock, either in the final check or in repairs, is thereby considerably simplified. The latter process can furthermore be improved by arranging the printed-circuit board which supports the electrical and mechanical portions of the clockwork so that the side which is provided with conductor lines is situated in the middle casing portion adjacent to the rear portion. By this measure, damage to the individual structural parts of the clockwork during replacement of the battery is prevented.

A further additional protection of the clockwork can be achieved by using a casing of rectangular shape, by arranging the battery or batteries behind the separating wall of the middle portion beside the clockwork and by providing a wall between the battery or batteries and the clockwork. By use of such a wall, the clockwork is also protected from any liquid which might escape from a corroded battery.

In a clock with an alarm device, it has proved suitable to fasten the clock on the front side of the separating wall in the area of the battery or batteries. This has substantial advantages during assembly. For the same reason, it is advisable to fasten the alarm device on the separating wall in such a manner that it engages the separating wall. In an embodiment preferred for reasons of manufacture, the alarm device comprises an electric buzzer and a manually operated switch, these two parts being combined to a one-piece structural unit.

According to one embodiment of the invention, the front portion and the rear portion of the casing are shaped as flat hoods. This makes it possible to construct the middle portion with a relatively small total height, whereby the accessibility to the electronic structural elements is improved. Beyond this, such an embodiment is also preferred to other possible embodiments for esthetic reasons.

A further assembly improvement is achieved according to a further concept of the invention by keeping the dial clamped between the front portion and the middle portion. Likewise it has proved practical to insert the sight glass in the front portion in such a manner that it engages the front portion.

For simple and uncomplicated control, in one embodiment of the invention the setting element for the hand setting (and possibly the one for the alarm-time setting) is shaped as a wheel, a section of the periphery of which projects from the casing edge. It has proved suitable to arrange each setting wheel in the separating plane between middle portion and rear portion, or between middle portion and front portion. The easy joining of clockwork and casing is thereby not rendered difficult, as would be the case if passage slots for the wheel or the wheels were provided in the casing. It has proved particularly advantageous for good manipulability of the clock to arrange each setting wheel in a casing corner of a rectangular casing.

In order to prevent dust and dirt from penetrating through the passage openings provided for the setting elements into the interior of the casing, it is advantageous to screen off each opening formed by the setting wheel in the casing by a wall which is molded to at least one casing portion and which extends behind the setting wheel.

According to a further concept of the invention, a single setting element is provided for both hand setting and alarm-time setting. This single setting element in a first axial position is coupled to the hand mechanism and in a second axial position is coupled to the alarm mechanism. Thus, not only is the manipulation of the clock considerably improved, but the expenditure for the structural parts is reduced and the assembly is simplified.

BRIEF DESCRIPTION OF THE DRAWINGS

FIG. 2 is an elevation of the front of the middle portion, as it appears with front portion removed;

FIG. 3 is a top plan view of the middle portion, with front and rear portions removed;

FIG. 4 is a rear elevation of the middles portion as it appears with rear portion removed; and FIG. 5 is a detail view showing a part of the rear portion of the casing and depicting the well for the setting wheel and the protective wall partially surrounding it.

DESCRIPTION OF THE PREFERRED EMBODIMENT

Figure 1:
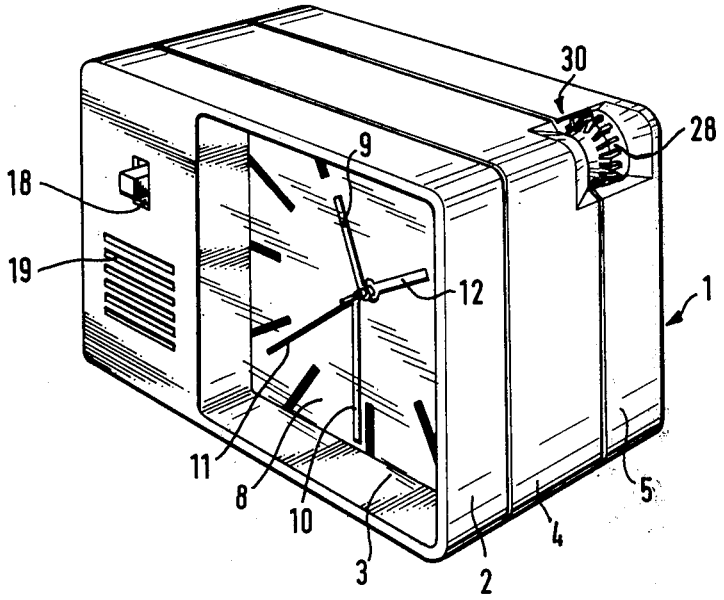
FIG. 1 is a perspective view showing the assembled clock as it appears from the front.

The battery-operated quartz-crystal clock has a substantially rectangular casing 1 of plastic material, which consists of a front portion 2 and a sight glass 3 inserted therein so as to engage it, a middle portion 4, and a rear portion 5. The three portions may be of the same or of different colors. Moreover, it is possible to produce a great variety of color combinations by exchanging the front portion and/or rear portion against a differently colored portion. The front portion 2 and the rear portion 5, which are both shaped in the form of flat hoods, are connected with middle portion 4 so as to engage the latter in a releasable manner. For this purpose there are molded to the insides of front portion 2 and rear portion 5 respectively opposite detents which engage corresponding recesses 6 or corresponding depressions 7.

A dial 8, which is held clamped between front portion 2 and middle portion 4, is provided behind sight glass 3. In front of the dial 8, the hour hand 9, the minute hand 10, and the second hand 11 rotate. Furthermore, in front of the dial 8 the alarm-time hand 12 is provided. A structural unit 15, comprising a buzzer 13 and a switch 14 forming a part of the alarm device, is fixed beside dial 8. Structural unit 15 is fastened to a separating wall 16 of the middle portion 4 so as to engage it. The detents are marked 17. The actuation button of switch 14 projects outward through a slot 18 in the front portion 2. Below slot 18 are arranged several transversal slots 19 through which the noise of buzzer 13 can penetrate to the outside.

On the rear side of separating wall 16 is mounted the clockwork 20 which consists of a mechanical portion, not shown, and an electrical portion 21 which are both mounted on the printed circuit board 22 of the electrical portion. The arrangement of the clockwork 20 is chosen in such a way that the surface of the printed circuit board 22 which supports the conductor lines 23 projects toward the rear. Thus the individual circuits can, while the clock is completely assembled, be tested at any time without difficulties. The space for the battery 24 is located beside the clockwork 20 and behind the structural unit 15. A separating wall 25 is provided between battery space 24 and clockwork 20 so that the clockwork 20 cannot be damaged during replacement of the battery 24. The electrical connecting lugs 26 and 27 pass from the battery space into the clockwork space through recesses in wall 25.

A setting wheel 28 is provided in a casing corner in the separating plane between middle portion 5 and rear portion 4. A section of the periphery of setting wheel 28 projects from the casing edge, which is recessed at this point. The setting wheel is coupled in the axial position shown, with the alarm device. After an axial movement toward the rear against the force of a spring (FIG. 1), the setting wheel 28 is uncoupled from the alarm device and coupled with the hand mechanism, so that the clock can be set in the second axial position.

As shown in FIG. 5, a wall 29 extending behind setting wheel 28 is molded to rear portion 5. This wall 29 screens off an opening 30 from the interior of the casing. Thus dust and dirt are prevented from entering the interior of the casing.

What is claimed is:

1. In an electric clock, a three-part casing having front and rear parallel walls and divided into front, middle and rear portions with meeting edges lying in first and second discrete planes, front to rear, spaced from and parallel with said walls, means detachably connecting said portions to conjointly form a closed casing, a separating wall detachably secured to said middle casing portion and lying essentially in said first plane, within said casing, a clockwork attached to the rearward side of said separating wall, and including a rearwardly-facing printed circuit board, a battery compartment formed by said middle portion and laterally spaced with respect to said clockwork, time indicating means viewable through an opening in said front wall and connected for operation by said clockwork, and circuit connections for said printed circuit board, including battery contacts in said compartment, said printed circuit board being exposed on detachment of said rear portion from said middle portion.

2. A clock according to claim 1, the assembled casing being rectangular, said battery compartment being arranged behind said separating wall and beside the clockwork, and a protective wall disposed between and separating said battery compartment and the clockwork.

3. The clock of claim 1, a structural unit detachably secured to the front side of said separating wall, in laterally-spaced relation with respect to said clockwork and forwardly of said compartment, an alarm device fixed with and extending forwardly of said structural unit and disposed in said front casing portion, said device including a switch with operating means projecting through an aperture in said front wall, laterally of said time-display opening.

4. A clock according to claim 3, said alarm device being detachably connected to said structural unit.

5. A clock according to claim 4, wherein the front casing portion and the rear casing portion are shaped in the form of flat hoods.

6. A clock according to claim 1, two contiguous ones of said casing portions conjointly defining an outwardly-opening well, a setting wheel journaled in said well by and between said two contiguous casing portions, a section of the periphery of said wheel being exposed in said well for manual actuation.

7. A clock according to claim 6, said well and setting wheel being arranged in said second plane between said middle and rear portions.

8. A clock according to claim 7, said well in the casing being screened off from the inside of the casing by a wall integral with at least one said casing portion and passes closely behind the setting wheel.

9. The clock of claim 1, said opening in said front wall being rimmed by rearwardly-extending flange means, said time-indicating means comprising a dial clamped between the rim of said flange means and said separating wall.

10. The clock of claim 6, said casing being in the form of a right parallelepipedon, said two contiguous portions being the middle and rear portions, said well being located at one upper corner of said casing.

11. The clock of claim 10, said wheel being journaled on an axis normal to said first and second planes.

12. The clock of claim 2, a time-settable alarm device mounted in said casing, for control by said clockwork, two contiguous ones of said casing portions conjointly defining at one upper corner, an outwardly-opening well, a manually-actuable setting wheel journaled by and between said two contiguous casing portions, in said well, for rotation on an axis normal to said first and second planes, said wheel being manually shiftable along said axis, from first to second position, for setting in said positions, respectively, said time-indicating means and said alarm device.

* * * * *